US006207331B1

(12) United States Patent
Akutsu et al.

(10) Patent No.: US 6,207,331 B1
(45) Date of Patent: Mar. 27, 2001

(54) AQUEOUS IMAGE RECORDING METHOD FOR ELECTROCHEMICALLY DEPOSITING AN IMAGE FORMING MATERIAL

(75) Inventors: Eiichi Akutsu; Shigemi Ohtsu; Lyong Sun Pu, all of Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/109,418

(22) Filed: Jul. 2, 1998

(30) Foreign Application Priority Data

Jul. 7, 1997 (JP) ..... 9-181620

(51) Int. Cl.[7] ..... G03G 17/04

(52) U.S. Cl. ..... 430/33; 204/478; 204/496; 204/508; 205/52; 205/136; 399/131; 399/237; 430/32

(58) Field of Search ..... 205/83, 82, 53–56, 205/136; 204/478, 496, 508, 509; 399/131, 237; 430/32, 33

(56) References Cited

U.S. PATENT DOCUMENTS

| | | | | |
|---|---|---|---|---|
| 5,190,582 | * | 3/1993 | Shinozuka et al. | 106/20 D |
| 5,693,129 | * | 12/1997 | Lin | 106/31.43 |
| 5,731,122 | * | 3/1998 | Yoshida et al. | 430/126 |
| 5,753,396 | * | 5/1998 | Nakamura et al. | 430/101 |
| 5,764,263 | * | 6/1998 | Lin | 347/101 |
| 5,848,332 | * | 12/1998 | Machid | 399/139 |
| 5,892,529 | * | 4/1999 | Tatsuura et al. | 347/139 |

FOREIGN PATENT DOCUMENTS

| | | | |
|---|---|---|---|
| 4083431 | * | 12/1977 | (JP) . |
| 4-9902 | | 1/1992 | (JP) . |
| 6-293125 | | 10/1994 | (JP) . |
| 7-54407 B2 | | 6/1995 | (JP) . |
| 7-181750 | | 7/1995 | (JP) . |

OTHER PUBLICATIONS

Tanemura, Hatsumi et al., High Quality Color Copy System Using Photographic Processt—Tone and Color Reproduction—, Fuji Photo Film, Ashigara Research Laboratories, date unknown, pp. 229–232.

Usui, Minoru, "MLChips: Multi–Layer Ceramic with Hyper–Integrated Piezo Segments: Development of the new MACH (MLChips type)," Seiko Epson Corporation, date unknown.

Caruthers, E.B. et al., "Modeling of Liquid Toner Electrical Characteristics," IS&T's Tenth International Congress on Advances in Non–Impact Printing Technologies (1994), pp. 204–209.

* cited by examiner

*Primary Examiner*—Kathryn Gorgos
*Assistant Examiner*—William T. Leader
(74) *Attorney, Agent, or Firm*—Oliff & Berridge, PLC

(57) ABSTRACT

The image recording process comprises the steps of preparing an aqueous coloring material liquid by dissolving or dispersing fine particles of a coloring material in an aqueous liquid, disposing an image supporting member and a counter electrode opposite thereto in the aqueous coloring material liquid, applying an electric current or an electric field corresponding to an image pattern between the image supporting member and the counter electrode, electrochemically depositing an image forming material containing the fine particles of the coloring material on the surface of the image supporting member thereby forming an image, and transferring the image forming material, in a condition where the image forming material contains 20 to 60% by weight of the aqueous liquid, onto a recording medium so as to record the image on the recording medium. This process, which is highly safe and simple, makes it possible to obtain a high-quality image by improving the transfer performance of the fine particles of the coloring material.

25 Claims, 8 Drawing Sheets

AQUEOUS IMAGE RECORDING METHOD FOR ELECTROCHEMICALLY DEPOSITING AN IMAGE FORMING MATERIAL

BACKGROUND OF THE INVENTION

1. Field of the Invention

The present invention relates to an image recording method wherein an image is recorded by electrochemically depositing an image forming material using an aqueous liquid containing fine particles of a coloring material.

2. Description of the Related Art

Many methods of using a liquid image forming material are known in image recording technologies used in offices. For example, silver salt recording technology, ink jet recording technology, and electrophotographic recording technology.

Printing technology using silver salt has been published in Tanemura Hatsumi et al., "HIGH QUALITY COLOR COPYING SYSTEM BY SILVER SALT PHOTOGRAPHIC METHOD", Preprint of Japan Hardcopy '89, p229. Printing technology using liquid development electrophotographic technology has been published in E. B. Caruthers et al., "Modeling of Liquid Toner Electrical Characteristics", Proceedings of IS & T 10$^{th}$ Int'l. Congress on Advances in Non-Impact Printing Technologies, p204 ('94). Printing technology using ink jet recording has been published in many technical reports such as Usui Minoru, "Development of a New Process MACH", Preprint of Japan Hardcopy '96, p161.

There are also proposed, for example, a technology using an electrodepositable liquid in which a coloring material is dispersed in an electrically insulating liquid so as to generate an electrical double layer (Japanese Patent Application Laid-Open (JP-A) No. 7-181750 or Japanese Patent Application Publication (JP-B) No. 7-54407); "Fine Pattern Forming Method" relating to an electrodeposition printing technology using a printing plate comprising an electrically conductive substrate with an insulating pattern formed thereon (JP-A No. 4-9902); and "Electrodeposition Offset Printing Method and Printing Plate" (JP-A No. 6-293125).

Properties required for printing technology for use in offices are, for example, a color high-quality image of 600 DPI (dots per inch) or higher and multi-gradation, capability of printing on plain paper, high image fastness comparable to that of a printed product, high safety of the recorded matter and the recording apparatus, almost no waste produced, and low running cost. However, none of the conventional technologies have reached the level at which the above-mentioned requirements are completely satisfied.

The recording method using silver salt, which is one of the conventional printing technologies, does not present problems of image quality or image fastness. However, the use of this method in an office is associated with problems, because this method is based on a printing process which involves a chemical reaction using chemically active agents and producing waste. The problems of ink jet printing technology are that high resolution cannot be easily obtained because of problems created by the small nozzle diameter in printing reliability; and that image fastness, safety, and printability on plain paper are inadequate, because the image forming material is usually an aqueous dye. Electrophotographic technology has no problem with regard to image quality, printability on plain paper, and high image fastness comparable to that of a printed product. However, electrophotographic technology has the disadvantages that a large amount of energy is consumed in the fixing unit of an electrophotographic apparatus; that the size of the apparatus is large because of the complicated printing process; and that safety and reliability problems arise.

In order to obtain an image having a high quality (resolution of a level of 1000 DPI, good color reproduction, and multi-gradation), the thickness of the image structure is preferably 2 microns or less, and more preferably 1 micron or less, in the light of the relationship between the range of color reproduction and the sharpness of image. Accordingly, the average particle size of the image forming material, as the element which imparts structure to the image, needs to be of a sub-micron order. However, since a fluidity problem arises if the average particle size of the image forming material is 5 $\mu$m or less, practical use of a powdery image forming material is difficult. In comparison , when viewed from this standpoint, the use of a liquid image forming material would be effective. In the step of forming an image having a size of the order of several microns, it is technically difficult to accurately control the movement of the particles of image forming material if the size of the particles is very small. Accordingly, an image forming method, in which an image is formed by using the electrophoresis of fine particles through a liquid, enables the accurate control of the movement of the particles and therefore is considered to be a very effective technical method.

The electrophotographic technology, which uses a developer in the form of an electrically insulating liquid and which is disclosed in, for example, JP-A No. 7-181750, is advantageous in that high resolution can be obtained because the size of the image forming material is of a sub-micron order; and in that image transfer can be easily performed at room temperature and printability on plain paper is high because the image formed can be altered while it is wet. However, since this method uses a developer comprising a hydrocarbon solvent, the solvent vapor presents a serious safety problem. Therefore, the use of such a developer is strictly regulated in some countries.

The electrodeposition printing technology using a printing plate comprising an electrically conductive substrate and an electrically insulating pattern formed thereon as described in JP-A No. 4-9902 is disadvantageous in that it is difficult to change image patterns for each printing because the process is complicated, for example, the non-image portion of an insulating resist needs to be prepared beforehand by photolithography. Other disadvantages are as follows. Since the apparatus to be used in this method is provided with a high precision, has a large size, involves many steps and produces a large amount of waste, it necessarily follows that the place where the apparatus is installed for printing is limited to a factory well equipped with facilities. Further, since the hysteresis of the image forming step tends to remain on the substrate, minute image recording cannot be fully reproduced. Furthermore, since the image forming portions in this method are concave, it is difficult to obtain a high quality image, because the selective adherence of particles to the image portions by electrophoresis is weakened and a large proportion of the liquid component of the image forming liquid material tends to remain on the image forming portions thus reducing the viscosity of the image forming material in the image forming portions, and consequently the image forming material in the image forming portions is liable to flow or cause a cohesive failure in the transfer step.

As described above, technologies of conventional image forming methods cannot satisfy the properties, i.e., a high degree of safety using a simple apparatus, required for printing for use in offices.

SUMMARY OF THE INVENTION

In order to realizea high quality (600 DPI ormore and multi-gradation), the minimum unit size of image forming material is preferably 1 micron or less. Therefore, it is necessary to use a liquid image forming material which can contain fine particles of a coloring material. When the installation of an apparatus in an office is taken into consideration, the liquid for use in the image forming material needs to be extremely safe. Preferably, water should be selected as the liquid as there are no problems regarding its safety. A printing process using a printing plate which cannot be regenerated is not suitable for use in an office, because office printing technology is required to prepare various sorts of printed matters in small quantities, easily, and at a low cost. Therefore, the market has a liking for a simple system which comprises inputting an image signal to produce image information for every printing and outputting the image information as an image of the image forming material adhered onto plain paper. In addition, when such factors as the fastness and high optical density of an image, the color formability of the image forming material, and the safety from the fact that the color forming material is not taken into human body are taken into consideration, it is necessary to use a coloring material comprising a combination of a pigment and a polymeric material. It is also necessary to keep the energy consumption to a minimum in the printing step.

The present invention has been made to address the aforementioned situation. Therefore it is an object of the present invention to obtain a high-quality image by use of fine particles of a coloring material and to provide an image forming method which is extremely safe and simple and has a wide area of use as well as to provide an image recording apparatus which is suited for the method.

The image forming method of the present invention comprises the steps of adding at least a coloring material composed of fine particles to an aqueous liquid, disposing an image supporting member and a counter electrode opposing thereto in the liquid, supplying an electric current or an electric field corresponding to an image pattern between the image supporting member and the counter electrode so as to electrochemically deposit the image forming material comprising the coloring material on the surface of the image supporting member thereby forming an image corresponding to the image pattern, and transferring the image forming material deposited on the surface of the image supporting member, in a condition where the image forming material contains 20% to 60% by weight of the aqueous liquid, to a recording medium so as to record the image on the recording medium.

The mechanism of the present invention is described below with reference to FIG. 1 which indicates the concept of the image recording method of the present invention. FIG. 1 is a schematic diagram illustrating an image recording phenomenon by electrochemical deposition. When a voltage is applied to a pseudo current supplying electrode 7 disposed on the image supporting member 3 on the image forming side thereof from a direct current power supply 8, the pH of an aqueous based coloring material liquid 1 in proximity to the electrode 7 changes and a colorant 9, which is dissolved or dispersed in the liquid 1, is deposited on the surface of the image supporting member 3 so that the deposited dye adheres imagewise to the surface to thereby record an image 10. Also dispersed in the liquid 1 is a counter electrode 5.

According to the image forming method of the present invention, after the coloring material is deposited on the surface of the image supporting member, a recording medium such as paper is brought into contact with the surface of the image supporting member having the image deposited thereon and then the recording medium is pressed, heated or the like. In this way, the image is transferred to the recording medium. FIG. 2A is a schematic diagram illustrating the above-described image recording process. The image 10 which is formed by the deposited dye is supported on the surface of the image supporting member 3. FIG. 2B is a schematic diagram illustrating the image transferring process. A sheet of plain paper 11 as a transfer-receiving medium is placed on with the image supporting member 3 taken out of the aqueous coloring material liquid 1, and then the paper 11 is pressed, or preferably pressed under heating, against the image supporting member 3 by means of a transferring roller 12 so that the colorant image 10 is transferred and fixed to the plain paper 11. FIG. 2C illustrates the image 10 which has been transferred and fixed to the plain paper 11. In this way, the process of recording the image on the plain paper 11 (transfer-receiving medium) is completed.

According to the image recording method, since the image forming material is in a condition where it contains 20 to 60% by weight of the aqueous liquid in the image transferring process, the image composition deposited and adhered to the image supporting member exhibits a viscous physical property which easily undergoes a plastic deformation by an external force. Therefore, the application of a pressure alone can cause a viscous deformation capable of transferring the image. In addition, since the transferring step is simplified and therefore the whole system is compact, an image forming process can be established which does not waste energy by heating or the like.

DETAILED DESCRIPTION OF THE INVENTION

Figure 1:
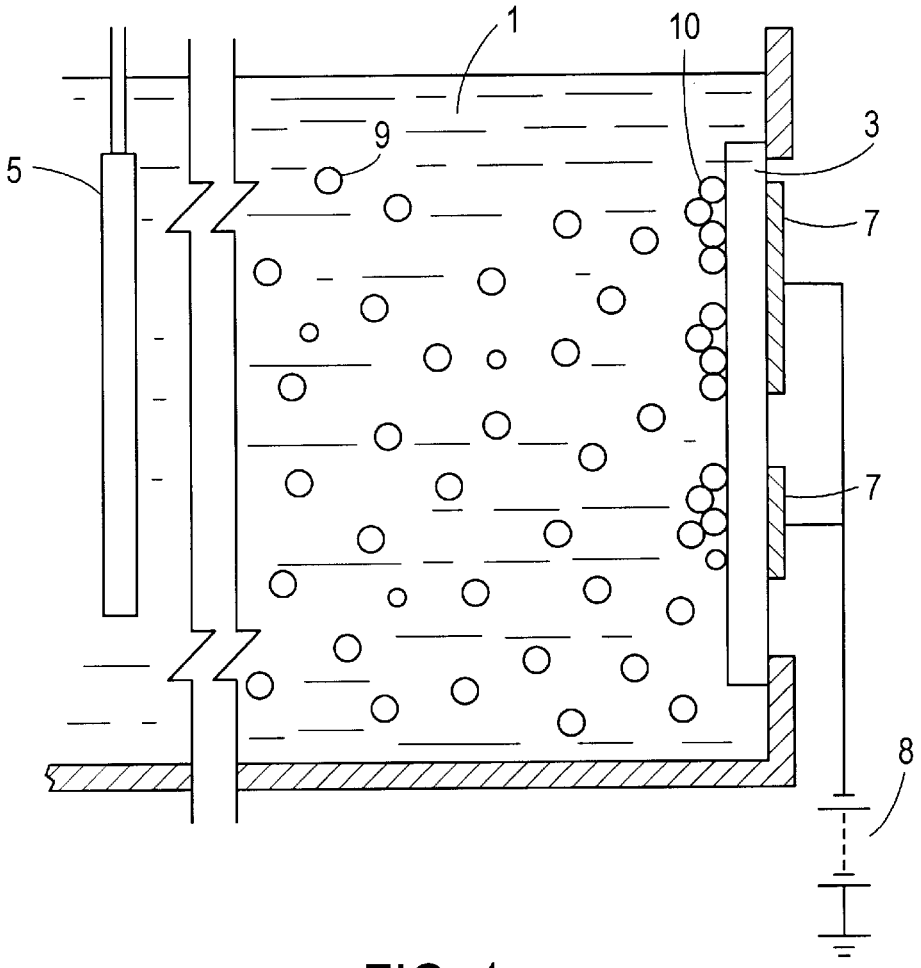
FIG. 1 is a conceptual diagram illustrating the dye deposition recording phenomenon of a colorant.

Details of the image recording method and the apparatus are given below.

The image forming method of the present invention comprises forming an image by the action of an electric current or an electric field supplied in accordance with an image pattern between the image supporting member and the counter electrode so as to electrochemically deposit a colorant dissolved in an aqueous liquid on the surface of the image supporting member. The aqueous liquid in which the colorant is dissolved is hereinafter referred to as an aqueous coloring material liquid.

The aqueous coloring material liquid is composed mainly of a coloring material composed of fine particles, water and a water-based solvent. In addition, the aqueous coloring material liquid may have added thereto a dispersant for use in electrodeposition, a wetting agent, a water-soluble polymeric material, an emulsion, a latex, solvents, a surfactant, a preservative, an anti-mold agent, a pH adjusting agent, a thermoplastic resin, and the like.

A dye which has no solubility or a low solubility in water or a pigment is suitable as the coloring material in a state of fine particles. Examples of the pigment which can be used include inorganic pigments such as carbon black, titanium oxide, zinc white, red iron oxide, alumina white, aluminum powder, bronze powder, zinc oxide, barium sulfate, magnesium carbonate, ultramarine blue, chromium yellow, cobalt blue, and Prussian blue; and organic pigments such as Toluidine Red, Permanent Carmine FB, Fast Yellow G, Bisazo Yellow AAA, Bisazo Orange PMP, Lake Red C, Brilliant Carmine 6B, Phthalocyanine Blue, Indanthron Blue, Quinacridone Red, Dioxazine Violet, Victoria Pure Blue, Alkali Blue toner, aniline black, Permanent Red 2B, Barium Lithol Red, Quinacridone Magenta, Naphthol Red HF4B, Phthalocyanine Green, and Benzimidazolone Red. Examples of oil-soluble dyes which can be used include Victoria Blue 4R Base, Nigrosin, Nigrosin Base, C.I. Solvent Yellow 19, C.I. Solvent Orange 45, and C.I. Solvent Red 8. Further, suitable properties can be obtained by using, for example, adispersedye, a dyed lake pigment, or a resin powder incorporated with a colorant. Preferably, the coloring material fine particles are those which can be converted into ions having a polarity opposite to that of the image supporting member.

As to the particles of the coloring material in an aqueous coloring material liquid, average particle diameter is in the range of from 0.01 to 0.9 $\mu$m, and preferably in the range of from 0.06 to 0.3 $\mu$m. In particular, a diameter in the range of less than 0.3 $\mu$m is preferable because an aqueous dispersion having an excellent dispersion stability can be obtained if the average particle diameter is within this range. If the average particle diameter is below the above-mentioned range, the light screenability of the image layer decreases to an extent that the optical image density tends to drop; the glossiness of the image is more than necessary; and safety problems tend to occur. On the other hand, if the average particle diameter is above the above-mentioned range, the dispersibility of the electrodepositable liquid containing the particles of the coloring material worsens to the extent that the uniformity of the image layer containing the particles of the coloring material is not satisfactory; the light screenability by the particles makes the color formability so poor that correspondence with a transmission-type image is impossible; and the image is matted more than necessary.

In the case where a dispersible coloring material, which is a dye insoluble in water or having a low solubility in water or a pigment, is used as a coloring material in the aqueous coloring material liquid, a dispersant for use in electrodeposition which causes the dispersion condition of the coloring material to change according to the change in pH, is used in combination with the coloring material. The dispersant for use in electrodeposition plays an important role in providing the dispersion stability of the particles of the coloring material in the aqueous liquid which is a main component of the electrodeposition liquid and in causing an adsorption phenomenon by electrodeposition. Accordingly, it is necessary for the dispersant for use in electrodeposition to take a molecular structure which has a hydrophilic group and a group tending to cause ionic dissociation in the aqueous liquid, or alternatively a group equivalent to a combination of the foregoing two groups. In addition, the electrical double layer composed of the dispersant needs to be observed to be compressed by a change in the pH so that the particles of the coloring material flocculate and are thus deposited. The function of the dispersant for use in electrodeposition needs to have the above-mentioned properties.

In the case where the image pattern part is electrically positive relative to a base electrode, the preferable structure of the dispersant for use in electrodeposition is the one which has at least one or more anionic groups represented by the following structural formula. If one or more of the dispersants for use in electrodeposition having this structure are linked or adhered to, or otherwise associated with the surface of the fine particles of the coloring material, a proper electrodeposition phenomenon takes place to prepare an electrodeposited film of the coloring material and, as a result, a proper image can be obtained. The term "base electrode" as used herein means an electrode having a potential of 0 level before the supply of a stimulus such as light, while the term "image pattern part" means the part which has been irradiated with light and has generated an electric current as a result of the irradiation.

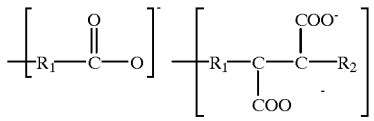

In the structural formula, $R_1$ and $R_2$ each may be any hydrocarbon group.

In particular, the structure in which the anionic group is a carboxylic group has excellent efficiency in depositing the fine particles of the coloring material in the electrodeposition phenomenon and therefore exhibits better properties.

Meanwhile, in the case where the image pattern part is electrically negative relative to the base electrode, the preferable structure of the dispersant for use in electrodeposition is one which has one or more cationic groups represented by the following structural formula. If one or more of the dispersants for use in electrodeposition having this structure are linked or adhered to, or otherwise associated with the surface of the fine particles of the coloring material, a proper electrodeposition phenomenon takes place to prepare an electrodeposited film of the coloring material and, as a result, a proper image can be obtained.

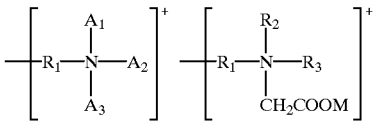

In the structural formula, $R_1$, $R_2$ and $R_3$ each may be any hydrocarbon group. $A_1$, $A_2$ and $A_3$ are each a hydrogen atom, an alkyl group, or an allyl group. M is a cation represented by a hydrogen ion, a metallic ion, or a hydrocarbon group.

The dispersants for use in electrodeposition, which exhibit excellent properties in terms of dispersion stability and film properties of the electrolytically adhered film, are a surfactant, a water-soluble polymer, and a polymer having a low degree of polymerization, each having the above-mentioned ionic substituent. Examples of the effective dispersant for electrolytic adhesion, which is a water-soluble polymer or a polymer having a low degree of polymerization, include alkylalkylene oxide carboxylate, alkyloxide carboxylate, alginic acid-modified carboxylate, carboxy-modified methylcellulose, polyacrylic acid-modified carboxylate, acrylic acid-modified carboxylate, polyethylene oxide-modified carboxylate, epoxy-modified carboxylate, polyethanolamine-modified methylcellulose, amine-modified alginate, and amine-modified polyacrylic acid.

The aqueous liquid means a hydrophilic liquid. A suitable aqueous liquid is a single substance or a mixture of two or more substances selected from the following substances, i.e., water; alcohols such as methanol, ethanol, butanol, and isopropyl alcohol; ketones such as acetone and methyl ethyl ketone; amines such as ethanol amine, dimethyl amine, and triethanol amine; and acids such as acetic acid, sulfuric acid, hydrochloric acid, phosphoric acid, oxalic acid, and phthalic acid. In particular, a mixed solvent whose main component is water is very useful from the viewpoints of safety, stability, and cost.

If desired, the aqueous coloring material liquid may contain the following additives in addition to the colorant and the solvent in so far as the effects of the present invention are not impaired.

The aqueous coloring material liquid may further contain a wetting substance in order to prevent the liquid from deteriorating due to the evaporation of the aqueous solvent component. It is desirable that the wetting substance to be added be a liquid which is highly hydrophilic and has an azeotropic point with water, a high boiling point and a low vapor pressure. Preferably, the liquid is a solvent which has a high polarity and which has a boiling point of 120° C. or higher and a saturated vapor pressure of $1.33\times10^4$ Pa or lower at room temperature under atmospheric pressure, and preferably a boiling point of 150° C. or higher and a saturated vapor pressure of $0.80\times10^4$ Pa or lower at room temperature under atmospheric pressure. Outside this range, the life of the dispersion liquid is shorter and a stable deposition performance cannot be obtained because the properties of the liquid largely change. The amount to be added is preferably in the range of from 0.5 to70% by weight, and more preferably in the range of from 5 to 30% by weight. Specific and typical examples thereof include ethylene glycol, diethylene glycol, polyethylene glycol, glycerin, diacetone alcohol, methyl cellosolve, ethyl cellosolve, butyl cellosolve, and ethylene glycol diacetate.

The addition of a polymeric additive and an emulsion imparts a stable film forming property at the time of electrolytic adhesion and is very effective in improving the film properties of the electrolytically adhered film, in improving the fastness of the electrolytically adhered image and in controlling the electrical resistance of the film. The amount to be added is preferably in the range of from 0.2 to 50% by weight, and more preferably in the range of from 1 to 15% by weight, based on solids.

Typical examples of the polymeric additive include gelatin, gum arabic, pectin, casein, starch, microcrystalline cellulose, alginates, polyvinyl alcohol, vinyl acetate copolymers, polyacrylic acid copolymers, and derivatives of methyl cellulose.

Typical examples of the emulsion include polyvinyl acetate emulsions, vinyl acetate copolymer emulsions, acrylate copolymer emulsions, and synthetic rubber latex.

Besides these, it is possible to add a preservative, an anti-mold agent, a very small amount of a surfactant, a pH adjusting agent, an agent which adjusts the viscosity of the liquid, and the like. It is necessary to add the preservative and the anti-mold agent in particular to the aqueous liquid, because the aqueous liquid is liable to deteriorate due to the growth of microorganisms and molds.

As for the composition of the aqueous coloring material liquid, the concentration of solids is from 1 to 30% by weight, and preferably from 5 to 19% by weight. If the concentration of solids is less than 1% by weight, it is difficult to obtain dispersion stability of the coloring material component, and it is also difficult to easily obtain a sufficient optical density of images. On the other hand, if the concentration of solids is more than 30% by weight, the uniformity of the liquid at the time of electrodeposition are liable to deteriorate and handling of he liquid becomes complicated because the liquid exhibits thixotropy.

The content of the fine particles of the coloring material, in the solids of the aqueous coloring material liquid, is preferably 30% by weight or more and 80% by weight or less. A content in excess of this range may cause excessively high gloss of the image or may reduce the transfer efficiency. On the other hand, a content less than this range tends to lead to disadvantages, for example, the optical density of images decreases due to the penetration or bleeding of liquid images; the image layer formation is defective or poor and fixing strength is low; and problems occur in the color formability or hue.

The viscosity of the aqueous coloring material liquid is preferably from 1 to 1000 cps, and more preferably from 10 to 200 cps. If the viscosity is less than this range, the attendant problem is that the droplets of the liquid are scattered because of the insufficient viscosity of the liquid. On the other hand, if the viscosity is in excess of this range, the problem is, that the stirring efficiency of the liquid drops because the electrodepositable liquid is not moved easily.

Figure 3:
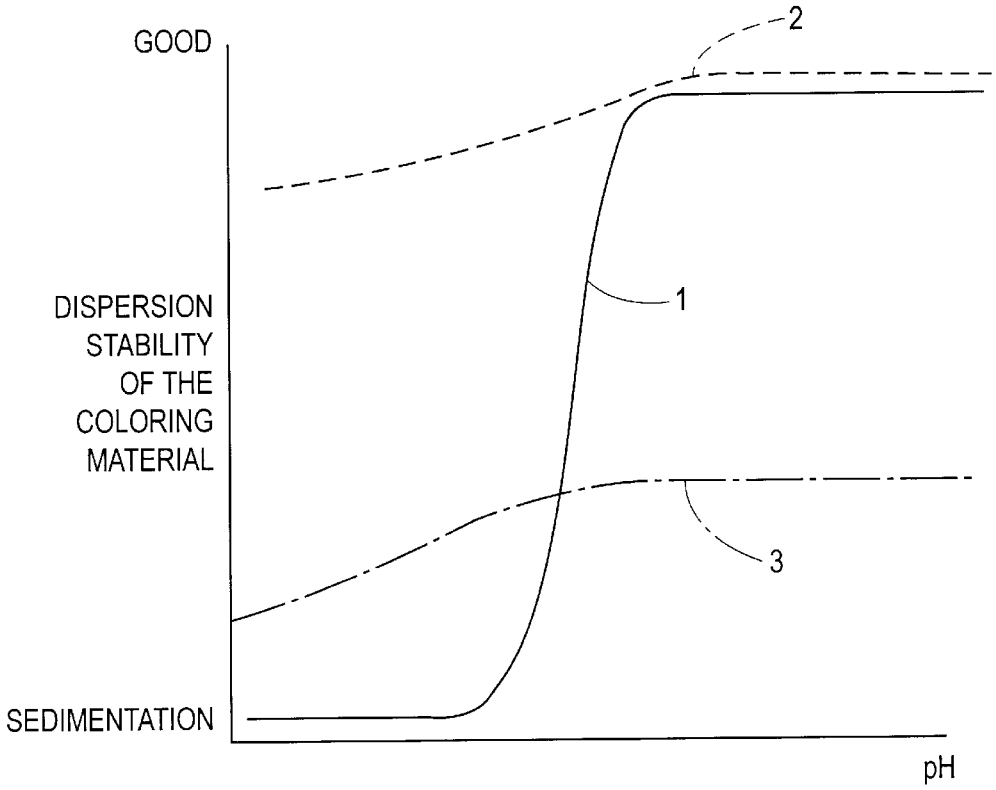
FIG. 3 is a graph indicating the relationship between the change in pH of an aqueous coloring material liquid and the dispersionstability of the coloring material.

The volume resistivity of the aqueous coloring material liquid is $10^5$ Ω·cm or less, and preferably $10^3$ Ω·cm or less. If the resistivity is in excess of this range, the electrodeposition voltage becomes so high that a bubbling phenomenon around the electrode becomes vigorous and the electrodeposition phenomenon becomes unstable and therefore the quality of the resulting films tends to vary. In the aqueous coloring material liquid, the solubility or the stability of the coloring material usually varies according to the change in pH. For example, as shown in FIG. 3, a system (curve 1), which indicates a clear tendency for the solubility and dispersibility of the coloring material to be good in alkaline regions and for the coloring material to be deposited and precipitated in acidic regions, is preferable in the present invention. On the contrary, a system (curve 2), in which a change in pH causes little change in the solubility and dispersibility of the coloring material and therefore the stability of solubility and dispersibility is high, and a system (curve 3), in which deposition and precipitation tend to easily occur, are not suitable to the present invention.

When setting the pH of the aqueous coloring material liquid, the pH is set to a value falling within the range of 1±2 plus the pH value at which the deposition starts, and preferably within the range of 1±1.5 plus the pH value at which the deposition starts, when the deposition method uses an anodic type electrodeposition material. On the other hand, the pH is set to a value falling within the range of 1±2 minus the pH value at which the deposition starts, and preferably within the range of 1±1.5 minus the pH value at which the deposition starts when the deposition method uses a cathodic type electrodeposition material so as to maintain a high electrodeposition film forming efficiency. If the pH is set to a value which is outside this range and which makes the deposition easier relative to the value at which the deposition starts, the dispersibility of the electrodepositable liquid is so unstable that the particles of the coloring material are deposited in non-image areas and the amount deposited varies. Further, if the pH is set to a value which is outside this range and which makes the deposition more difficult relative to the value at which the deposition starts, resulting disadvantages are, for example, that the electrodeposition film forming efficiency is low and the electrodeposition potential rises; and that the properties of the film formed are not satisfactory.

According to the image recording method of the present invention, after the coloring material is deposited on the surface of an image supporting member, a recording medium such as paper is brought into contact with the side of the image supporting member on which the deposited image is present, and then the image is transferred onto the recording medium by the application of, for example, pressure or heat.

As to the image supporting member to be used in the present invention, the requirements are that the surface on which images are formed is highly smooth and free from unevenness so as to obtain good printing performance and that the surface energy is low so as to obtain good transfer performance. In addition, these properties are also important from the viewpoint of the prevention of the image retention on the image supporting member in the case where the image supporting member is used repeatedly.

More specifically, in order to obtain good transferability, the surface roughness (Ra) of the surface of the image supporting member is in the range of from 0.01 to 1.2 $\mu$m, and preferably in the range of from 0.06 to 0.6 $\mu$m. If the surface of the image supporting member is too rough, the resulting increase in the contact area and the physical anchoring effect increases the adhesion between the coloring material of the image and the surface of the image supporting member to an extent that the transferability of the image of the coloring material decreases. For this reason, the surface of the image supporting member needs to be smooth. However, if the surface smoothness is increased to the level of a specular surface, the surface of the image formed by transfer becomes too glossy and glaring, thereby causing a visual problem.

In addition, in order to obtain good transferability, the critical surface tension of the surface of the image supporting member is in the range of from 19 to 39 dyne/cm, and preferably in the range of from 22 to 36 dyne/cm. The reduction of the critical surface tension of the surface of the image supporting member results in the physical reduction of the adhesion between the coloring material of the image and the surface of the image supporting member so that that the transferability of image and the uniformity of image transfer are effectively improved. However, if the surface tension is less than 19 dyne/cm, the adhesion of the image is so poor that the image tends to flow and the image to be adhered is repelled to the extent that the image cannot accurately correspond to the fine patterns. On the other hand, if the surface tension is more than 39 dyne/cm, the adhesion between the image to be adhered and the image supporting member is so strong that a cleanability problem arises.

These properties make it possible not only to obtain good image properties but also to improve the physical cleanability of the image on the image supporting member. As a result, even if the image is different for every recording, it is possible to establish a printing cycle which is free from the hysteresis of the image information of the preceding recording.

An effective method for reducing the surface energy is to form a low energy layer on the surface. Examples of the material providing such a surface layer include a fluororesin, a fluororubber (FEP), a dimethylsiloxane resin, a silicone rubber, and a composite material comprising any of these materials and an electrically conductive powder so as to control the electrical resistance of the layer itself.

The thickness of the low surface energy layer is usually in the range of from 0.02 to 5 $\mu$m, and preferably in the range of from 0.02 to 1 $\mu$m. If the thickness is more than 5 $\mu$m, the quality of the printed image is reduced because the reduction in electrical conductivity causes the printing voltage to rise and the electric current to diffuse. In addition, the energy efficiency decreases, because the distance from the heat generating layer to the object to be heated increases, thereby producing more loss in heat transfer. On the other hand, if the thickness is less than 0.02 $\mu$m, film defects tend to occur and the surface tension tends to fluctuate.

In the present invention, the image supporting member at the heat generating portion has a multilayered structure comprising a heat generating layer sandwiched between a pattern electrode layer and an electrically conductive layer, wherein these layers may be stacked on a substrate in the order of the pattern electrode layer, the heat generating layer and the electrically conductive layer, or alternatively in the order of the electrically conductive layer, the heat generating layer and the pattern electrode layer.

The pattern electrode layer which constitutes the heat generating portion is designed to address an input current to be passed through the heat generating layer and therefore functions as an addressing/inputting electrode layer so as to locally generate heat in the heat generating layer. Accordingly, the pattern electrode is in a shape convenient for addressing. For example, it may be a belt or a line following the shape of the heat generated or a combination of these shapes, or alternatively may be an electrode separated into various shapes, provided, however, that at least a single or both side peripheries of the pattern electrode are exposed to the single or both side peripheries of the heat generator to thereby constitute part of the current passing portion for supplying an input current locally to a portion of the pattern electrode layer.

Figure 4A:
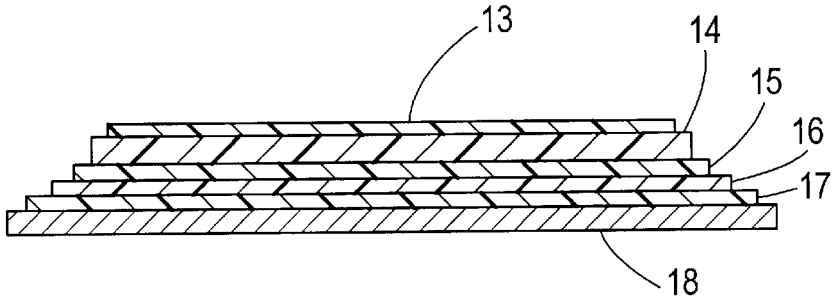
FIG. 4A is a transverse cross-sectional view of an image supporting member having a transparent heat generator.
Figure 4B:
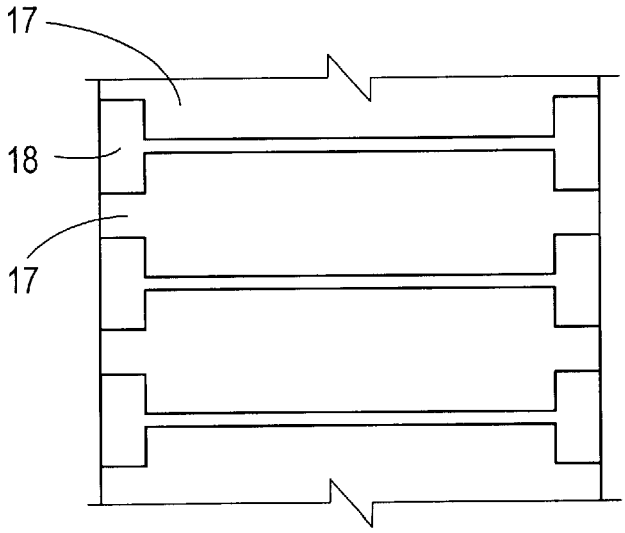
FIG. 4B is a partial schematic view illustrating the shape of the pattern of a pattern ITO layer.

The image supporting member having a transparent heat generator is specifically described below. FIG. 4A is a transverse cross-sectional view of an image supporting member having a transparent heat generator. FIG. 4B is a partial schematic view illustrating the shape of the pattern of a pattern ITO layer. On the outermost surface of the image supporting member there is formed a low surface energy layer 13, underneath which a photoconductive layer 14, an ITO layer 15, a transparent heat generator layer 16, a pattern ITO layer 17, and a transparent substrate 18 are formed in this order by lamination. In this specific example, the pattern ITO layer 17 is in the shape as shown in FIG. 4B with respect to the transparent substrate 18.

A material for the pattern electrode layer is not particularly limited, as long as the material has excellent electrical conductivity. Examples of the material include a thin film such as a sputtering or vacuum-deposited film of a metal or an electrically conductive ceramic, or a screen-printed film of an electrically conductive paste. The film is made into a desired pattern by a method such as photolithography or screen printing. The thickness of the pattern electrode layer is usually 5 μm or less, and preferably 1 μm or less. If the thickness is more than 5 μm, the amount of generated heat which leaks from the electrode layer increases and the temperature of the heat generating layer drops relative to the inputted current.

The electrically conductive layer constituting the heat generator is a return circuit electrode layer for the electric current which is supplied from the pattern electrode layer into the heat generating layer and generates heat in the heat generating layer. Like the pattern electrode layer, the electrically conductive layer is usually made of a material having excellent electrical conductivity and is in a shape of a thin film, wherein at least a single or both side peripheries of the electrically conductive layer are exposed to the single or both side peripheries of the heat generator to thereby constitute part of the energizing passing portion as a return circuit for the energizing inputted from the pattern electrode layer.

Examples of the material suited for the electrically conductive layer include a thin film such as a sputtering or vacuum-deposited film of a metal or an electrically conductive ceramic, or a screen-printed film of an electrically conductive paste. The thickness is usually 10 μm or less, and preferably 0.5 μm or less. If the thickness is more than 10 μm, the amount of generated heat which leaks from the electrode layer increases and the temperature of the heat generating layer drops relative to the inputted current.

The heat generating layer which constitutes the heat generator is interposed between the pattern electrode layer and the electrically conductive layer and is designed to generate Joule heat locally by the electric current addressed/inputted therebetween. The heat resistance of the heat generating layer is 200° C. or more, and preferably300° C. or more. The volume resistivity of the heat generating layer is in the range of from $10^{-3}$ to $10^{7}$ Ω·cm, and preferably in the range of from $10^{-1}$ to $10^{3}$ Ω·cm.

The heat generating layer can be usually made by blending or chemically combining one or more electrically conductive materials, such as conductive ceramics, conductive carbonous materials or metals, with one or more electrically insulating materials such as insulating ceramic materials or heat-resistant resins.

Specific examples of the electrically conductive materials include carbon and metals such as C, Ni, Au, Ag, Fe, Al, Ti, Pd, Ta, Cu, Co, Cr, Pt, Mo, Ru, Rh, W, and In; and compounds such as $VO_2$, $Ru_2O$, TaN, SiC, $ZrO_2$, InO, $Ta_2N$, ZrN, NbN, VN, $TiB_2$, $ZrB_2$, $HfB_2$, $TaB_2$, $MoB_2$, $CrB_2$, $B_4C$, MoB, ZrC, VC, and TiC. Examples of the heat-resistant resins include polyimide resins, polyaramide resins, polysulfone resins, polyimideamide resins, polyester-imide resins, polyphenylene oxide resins, poly-p-xylylene resins, polybenzimidazole resins, resins derived therefrom, modified resins thereof, and composite materials thereof. In addition, examples of electrically insulating materials which are used for resistivity controlling and binding purposes include ceramic materials such as AlN, $SiN_4$, $Al_2O_3$, MgO, $VO_2$, $SiO_2$, $ZrO_2$, $MO_2$, $Bi_2O_3$, $TiO_2$, $MoO_2$, $WO_2$, $NbO_2$, and $ReO_3$ as well as the above-mentioned heat-resistant resins.

Preferred examples of the material for the heat generating layer include a polyimide resin having carbon dispersed therein, a silicone resin having Ni particles dispersed therein, a ceramic material comprising a blend of Ta and $SiO_2$, and a material comprising RuO and $SiO_2$. The thickness of the heat generating layer is usually 20 μm or less, and preferably in the range of from 1 to 5 μm or less. If the thickness is more than 20 μm, the heat generating efficiency relative to the inputted power drops and the energy consumption increases.

The image supporting member having the above-described structure is incorporated into an image recording apparatus together with a power supplying mechanism which supplies an electric current from the current passing portion formed at a single or both side peripheries of the heat generator selectively to the heat generating layer interposed between a pattern electrode and an electrically conductive layer. In this way, an image transferring/fixing unit by means of heating or heating under pressing is formed.

For example, an electrode in the shape of a roller capable of making a dynamic contact or in the shape of rectangle capable of making a static contact is incorporated in the unit, while, on the electrically conductive layer side exposed to the side peripheries of the heat generator, an electrode capable of making the same dynamic contact or static contact as described above is disposed in an appropriate position, preferably in a position opposite to the dynamic or static contact which is made on the pattern electrode side, to thereby form the unit.

The input current which is passed via the dynamic or static contact from the pattern electrode and through the heat generating layer to the electrically conductive layer may be an alternating current, a pulse current, or a modulated current thereof. The current is preferably a pulse current in consideration of temperature control and the like.

As described above, in the unit mounted with the image supporting member of the present invention, an electric current is passed locally to part of the pattern electrode layer so that part of the heat generating layer corresponding to that part of the pattern electrode layer generates heat. Therefore, when an image, which is made of a coloring material and is supported on the image supporting member, is transferred to an image recording medium such as paper, only the necessary parts are heated, for example, only the image portion to be transferred is heated under pressure. In this case, since the heat generating portion, i.e., the heat generating layer, of the image supporting member and the image, which is made of a coloring material present on the image supporting member and which is to be transferred, are very close to each other and since only the necessary part is locally heated by the heat generation, the heat capacity is small. This small heat capacity enables the image of the coloring material for transfer to reach a high temperature instantly. Further, because of the small heat capacity, the temperature of the heat generating layer drops in a short period of time and can be reduced to a temperature in the neighborhood of room temperature. As a result, the total amount of energy for heat generation can be made small and the rise in temperature of the whole apparatus can be prevented by the localized heat generation described above.

Further, an apparatus such as the image transferring unit mounted with the image supporting member of the present invention can also be equipped, if necessary, with a cooling mechanism which is designed for preventing a rise in temperature of the whole apparatus.

Furthermore, it is possible to easily control the amount of heat generated at the heat generating portion of the image supporting member by providing the unit with a temperature detector which detects the temperature of the heat generator and with a power supply controlling mechanism which controls the power supply to the heat generating layer according to the temperature detected by the temperature detector. Providing the detector and mechanism effectively ensures a good transferred image can be obtained.

For example, where the contact electrode is composed of a plurality of separated electrodes, a suitable structure is composed of a block-separating circuit for separating an image signal into blocks corresponding to the separated electrodes, a setting circuit (for example, a pulse width setting circuit, a pulse number and timing setting circuit, and the like) for detecting the image signal from the block-separating circuit and the environmental temperature to thereby set the amount of electric energy to be supplied to the respective separated electrodes, and a driving circuit for providing the electricity amount to be used for heating based on the output signal from the setting circuit.

If the image supporting member is in a shape of a belt, the recording of image can be performed effectively because the recording, transfer to the transfer-receiving medium and fixing of an image can be performed continuously.

When preparing such a belt-shaped image supporting member, the materials for the substrate are, for example, polymers, such as polyimide resins and modified compounds thereof, polyaramide resins and modified compounds thereof, and silicone resins and modified compounds thereof as well as materials composed mainly of these polymers. If the image supporting member is in the shape of a belt, the coloring material adhering to the surface can be effectively removed by bending the belt at an acute angle, which makes it possible to improve the physical cleanability of the image on the image supporting member. As a result, even if the image is different for every recording, it is possible to establish a printing cycle which is free from the hysteresis of the image information of the preceding recording.

Examples of the method for recording images by transferring images recorded on an image supporting member onto a recording medium such as plain paper include methods wherein images which are formed by deposition on the image supporting member are transferred by using electrostatic force, pressure, adhesiveness, chemical binding force, wettability, or the like.

In the present invention, the image transfer is performed in a state where the image of the image forming material contains an appropriate amount of the liquid component of the electrodeposition liquid.

When an image is deposited on the surface of the image supporting member, the viscosity of the depositing image abruptly rises due to concurrent dehydration thereof. However, in the present invention, since the image deposited still contains a large percentage of water, it has a viscous physical property and easily undergoes a plastic deformation by an external force. Because of this property, the application of pressure alone can cause the viscous deformation of the image and enables the transfer of the image. In addition, since the transferring process is simplified and the whole system is compact, it is possible to establish an image forming process which does not waste energy.

When an image is transferred, the content of liquid in the image portion is preferably in the range of from 20 to 60% by weight, and more preferably in the range of from 30 to 50% by weight. The term "content of liquid" as referred to herein means the ratio of the difference between the weight of the image forming material before drying, i.e., the weight which is obtained by subtracting the weight of the image supporting member itself from the weight of the image supporting member taken out of the aqueous based coloring material liquid after the formation of images, and the weight of the image forming material after drying, i.e., the weight which is obtained by subtracting the weight of the image supporting member itself from the weight of the image supporting member after drying the image supporting member having the image formed thereon in an oven maintained at 120° C., to the weight of the image forming material before drying.

If the content is a value larger than this range, it is difficult to obtain a high-quality image due to the collapse of fine lines or the impairment of dot gains, because the image portion is so soft that the image tends to be deformed or spread at the time of transfer. On the other hand, if the content is a value smaller than this range, satisfactory results cannot be obtained, because the image portion is so hard that poor transfer or poor fixing occurs at the time of transfer.

It is desirable that the content of the liquid in the image portion at the time of transfer be controlled by the voltage which is applied between the electrode and the image supporting member in the image forming process. If the voltage to be applied is large, the coloring material flocculates into hard particles and the content of the liquid drops. The voltage to be applied between the electrode and the image supporting member is preferably a direct current voltage of 9 V or less. However, signals may be inputted by a direct current pulse having intervals of short periods or by the superposition of the short pulses in order to sharply reproduce every pixel of the image. The applied voltage is preferably a direct current voltage of 5 V or less, and more preferably a direct current voltage of 3 V or less if more importance is attached to the quality of the film formed. If a voltage of 9 V or more is applied, the coloring material flocculates into hard particles and the content of the liquid drops, and bubbles are vigorously produced from the electrode surface in the liquid due to electrolysis thereof. Therefore, the distribution of the electric field on the electrode surface becomes so nonuniform that the quality of the produced film itself becomes heterogeneous and the film surface becomes uneven. As a result, it becomes difficult to reproduce an image having the desired fine pattern. On the other hand, a voltage less than 1.0 V is not desirable, because the pH does not drop and the pH changes so little that flocculation does not easily occur.

In a conventional electrodeposition coating, the voltage applied for the electrodeposition is in the range of from 150 to 300 V. This is because, since the film formed has a high electrical resistance, if the applied voltage is low, the film forming rate by the electrodeposition drops remarkably and the necessary film thickness cannot be obtained as the film formation by the electrodeposition proceeds. In order to avoid this problem, a high voltage is applied to carry out electrolysis causing vigorous bubble formation which is utilized to stir the liquid in the proximity of the electrode surface so that a fresh electrodepositable liquid is brought into contact with the electrode surface. Thus, the thickness (in general 20 $\mu$m ormore) necessary for electrodeposition coating is obtained.

The object of the present invention is to reproduce a high-quality image, and more specifically to reproduce a fine image pattern having a thickness of 1 $\mu$m or less. Therefore, it is necessary to inhibit the bubbling phenomenon which is caused by the electrolysis of the electrodepositable liquid and which impairs the sharpness of image. Even if bubbles are formed, the bubble formation is reduced to a level which does not adversely affect the reproduction of the fine image pattern. Because of this, the applied voltage is preferably 9

V or less, more preferably 5 V or less, or 3 V or less by direct current electric field if more importance is attached to the quality of the image formed. Further, from the standpoint of the stability of the voltage, it is preferable to use a tri-electrode system as the voltage applying means.

Next, an image recording apparatus according to the present invention is described below.

Figure 5:
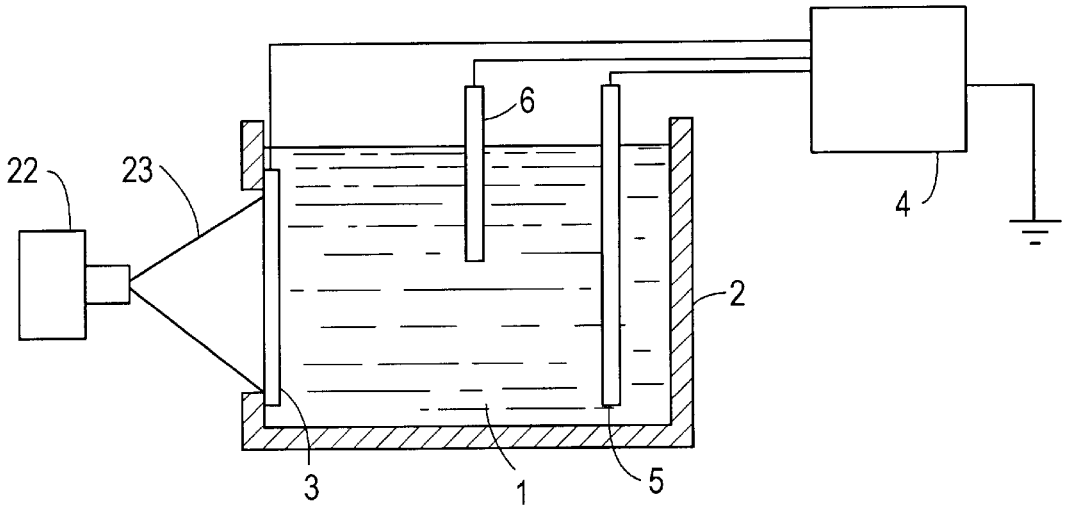
FIG. 5 is a schematic diagram illustrating the image recording process of the present invention.

FIG. 5 is a schematic diagram illustrating the image recording apparatus according to the present invention to be used in Example 1 described later. The image recording apparatus comprises an electrodeposition bath 2 filled with an electrodepositable aqueous based coloring material liquid 1. In the bath 2 is disposed an image supporting member 3, whose rear surface is fitted with a working electrode so that an image signal can be inputted, in such a manner that the rear surface is exposed to the outside of the bath. Further, in the bath 1 are disposed a counter electrode 5 and a controlling electrode 6 utilizing a salt bridge. The image supporting member 3 has a multilayered structure comprising a 4 mm thick plate glass substrate having a transparent electrically conductive layer of ITO formed thereon, and the transparent electrically conductive layer is covered with two organic photoconductive layers. The electrically conductive layer of ITO functions as a working electrode and the surface of the organic photoconductive layer is smooth without unevenness. The respective electrodes are connected to a potentiostat 4. An image signal is inputted into an optical image inputting section on the rear surface of the image supporting member 3 while a voltage is applied between the working electrode and the counter electrode 5 by means of the potentiostat 4 so that the coloring material in the coloring material liquid is deposited on the surface of the image supporting member 3 to thereby form an image. An image signal is inputted into an optical image inputting section on the rear surface of the image supporting member 3 by an image-projecting light 23 radiated from an image projecting device 22. Also dispersed in the liquid 1 is a counter electrode 5. The image thus recorded may be transferred and fixed to a transfer-receiving medium such as plain paper or a plastic film, if desired.

Figure 6:
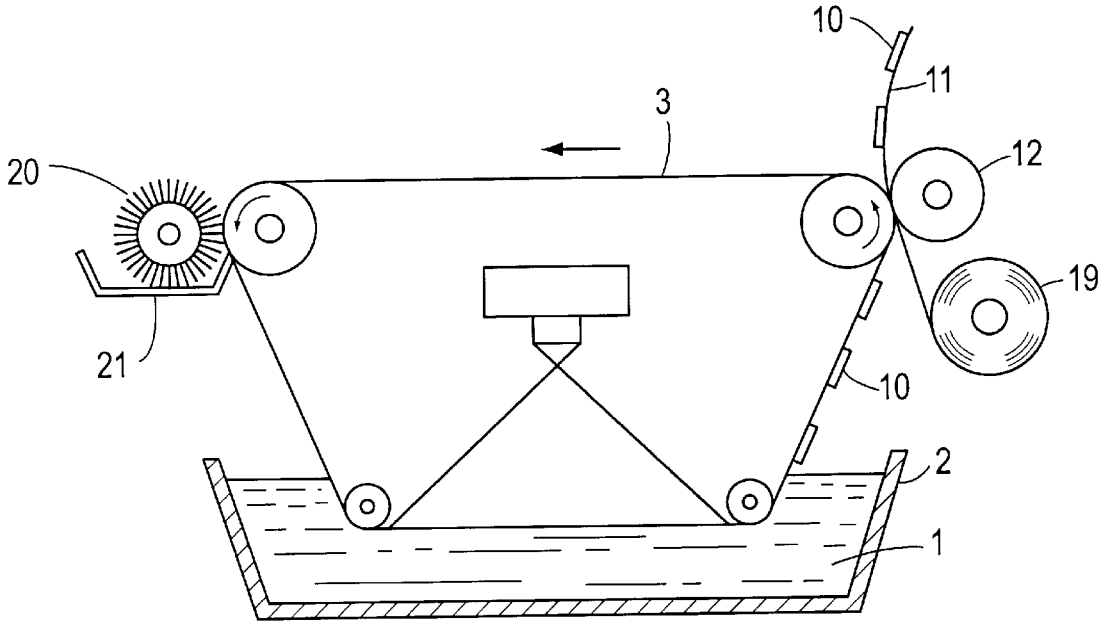
FIG. 6 is a schematic diagram illustrating an embodiment of the image recording system according to the present invention, wherein use is made of an image recording apparatus having an image supporting member in the shape of a belt.

FIG. 6 is a schematic diagram illustrating another embodiment of the image recording apparatus system according to the present invention. Since the image supporting member 3 is in the shape of a belt, an image 10, which is recorded by receiving an optical signal in the aqueous based coloring material liquid 1, is conveyed forward while being adhered to the surface of the belt-shaped image supporting member 3. In the transferring section, the image 10 is transferred to a paper 11 supplied from a paper roll 19 when the image 10 passes through a gap between pressing and heating rolls 12. The colorant remaining on the image supporting member 3 is removed with a cleaning brush 20 and is accumulated in a bowl 21 for cleaning waste. The image supporting member 3, after being cleaned by the cleaning brush 20, is again used for image recording.

In these apparatuses, in order to maintain the uniformity of the electrodeposition liquid bath, it is preferable to stir the liquid in the bath. Stirring the liquid makes it possible to form a uniform film and improve the film forming efficiency. However, too vigorous stirring must be avoided in order not to cause problems such as retardation of the film formation or scattering of the liquid.

Control of the liquid temperature makes it possible to obtain a more uniform and better film. Since the electrodeposition phenomenon itself is influenced by the liquid temperature, a liquid temperature controlling system having a particularly high accuracy must be installed in order to reproduce a high-quality image.

In the case of optical writing, the image supporting member must comprise at least a planar electrode layer and a photoconductive material layer so that an electric current flows in the image supporting member portion irradiated with light to thereby cause the electrolytic adhesion phenomenon of the fine particles of the coloring material.

The image forming material is removed from the surface of the image supporting member by a cleaning method such as blade-cleaning, fur-brushing, cleaning by means of an elastic roller, cleaning by means of a cleaning web, or the like.

As stated above, the image forming method of the present invention comprises the steps of forming an image by depositing a coloring material on an image supporting member capable of allowing an electric current to flow in an aqueous coloring material liquid according to an image signal and then transferring the image, in a condition where the image contains the aqueous liquid, to a recording medium so as to record the image on the recording medium. The printing by this image recording method is featured by low energy consumption, high optical density, high resolution, image structure with a low thickness, adhesion of image, high fastness of image, high safety, and the like.

EXAMPLES

Example 1

15 parts by weight of carbon black powder (having an average particle diameter of 0.08 $\mu$m), 15 parts by weight of diethylene glycol, 3 parts by weight of potassium polyoxyethylene alkylether carboxylate, 3 parts by weight of potassium polyethylene glycol dicarboxylate, 6 parts by weight of a water-soluble acrylic resin, 3 parts by weight of isopropanol, and 65 parts by weight of distilled water were mixed, and moderately stirred for 1 hour by means of a propeller to sufficiently wet the carbon black powder with the liquid and thus to prepare a dispersion liquid containing roughly dispersed carbon black powder. This dispersion liquid was then subjected to an intensive, forced-dispersing treatment using a homogenizer for 3 minutes to prepare a base dispersion liquid. Into this based is person liquid was drop wise added a dilute solution containing 120 parts by weight of distilled water, 6 parts by weight of glycerin, and 0.8 parts by weight of an anti-mold agent ((Proxycel XL-2 manufactured by ICI Inc.) while the liquid was stirred with a propeller. In this way, a dispersion liquid containing fine particles of a coloring material for use in electrodeposition was prepared. The pH of this liquid was set to 6.5 by adjusting pH the using an aqueous solution of phosphoric acid and an aqueous solution of potassium hydroxide. The pH at which the fine particles of the coloring material started depositing from the volume liquid was 5.0. The resistivity of the liquid was $9\times10^{1}$ $\Omega\cdot$cm.

In the image recording apparatus as illustrated in FIG. 5, this aqueous based coloring material liquid was used to record an image. As shown in FIG. 5, in an electrodeposition bath 2 filled with the electrodeposition liquid 1 was disposed an image supporting member 3, whose rear surface was fitted with a working electrode so that an image signal could be inputted, in such a manner that the rear surface was exposed to the outside of the bath. Further, in the bath 2 were disposed a counter electrode 5 and a controlling electrode 6 utilizing a salt bridge. The image supporting member 3 had a multilayered structure comprising a 4 mm thick plate glass substrate having a transparent electrically conductive layer of ITO formed thereon, and the transparent electrically conductive layer was covered with two organic photoconductive layers. The electrically conductive layer of ITO functioned as a working electrode and the surface of the organic photoconductive layer was smooth without unevenness. The surface roughness (Ra) of the surface was 0.2 μm, and the critical surface tension was 26 dyne/cm. The respective electrodes were connected to a potentiostat power source. An image signal was inputted into an optical image inputting section on the rear surface of the image supporting member by an image-projecting light 23 radiated from an image projecting device 22 while a DC voltage of 2.8 V was applied between the working electrode and the counter electrode for 5 seconds by means of the potentiostat power source.

Next, the image supporting member was withdrawn from the liquid. Then, 10 seconds later, a sheet of plain paper was placed on the surface of the image supporting member having the image adhered thereto, and the image was transferred to the plain paper by bringing a rubber roller having a diameter of 50 mm into contact with the image supporting member by providing a line pressure of 250 g/cm, with the plain paper being sandwiched therebetween. At the time of the transfer, the image portion had a liquid content of 34% by weight. After the completion of the image formation, it was confirmed that a high-quality image having an optical image density of 1.31 was formed on the plain paper.

Example 2

35 parts by weight of carbon black powder (having an average particle diameter of 0.06 μm), 10 parts by weight of polyethylene glycol, 12 parts by weight of ammonium polymethyl acrylate dicarboxylate, 5 parts by weight of ammonium polyoxyethylene alkylphenylcarboxylate, 10 parts by weight of a water-soluble acrylic resin, and 70 parts by weight of distilled water were mixed, and moderately stirred for 3 hours by means of a propeller to sufficiently wet the carbon black powder with the liquid and thus to prepare a dispersion liquid containing roughly dispersed carbon black powder. This dispersion liquid was then subjected to a dispersing treatment using a ball mill for 24 hours to prepare a base dispersion liquid. Into this base dispersion liquid was dropwise added a diluent containing 100 parts by weight of distilled water and 0.5 parts by weight of an anti-mold agent ((Proxycel XL-2 manufactured by ICI Inc.) while the liquid was stirred with a propeller. In this way, a dispersion liquid containing fine particles of a coloring material for use in electrodeposition was prepared. The pH of this liquid was set to 6.0 by adjusting pH by an aqueous solution of phosphoric acid and an aqueous solution of ammonium hydroxide. The pH at which the fine particles of the coloring material started depositing from the liquid was 5.0. The volume resistivity of the liquid was $2\times10^2$ Ω·cm.

Figure 7:
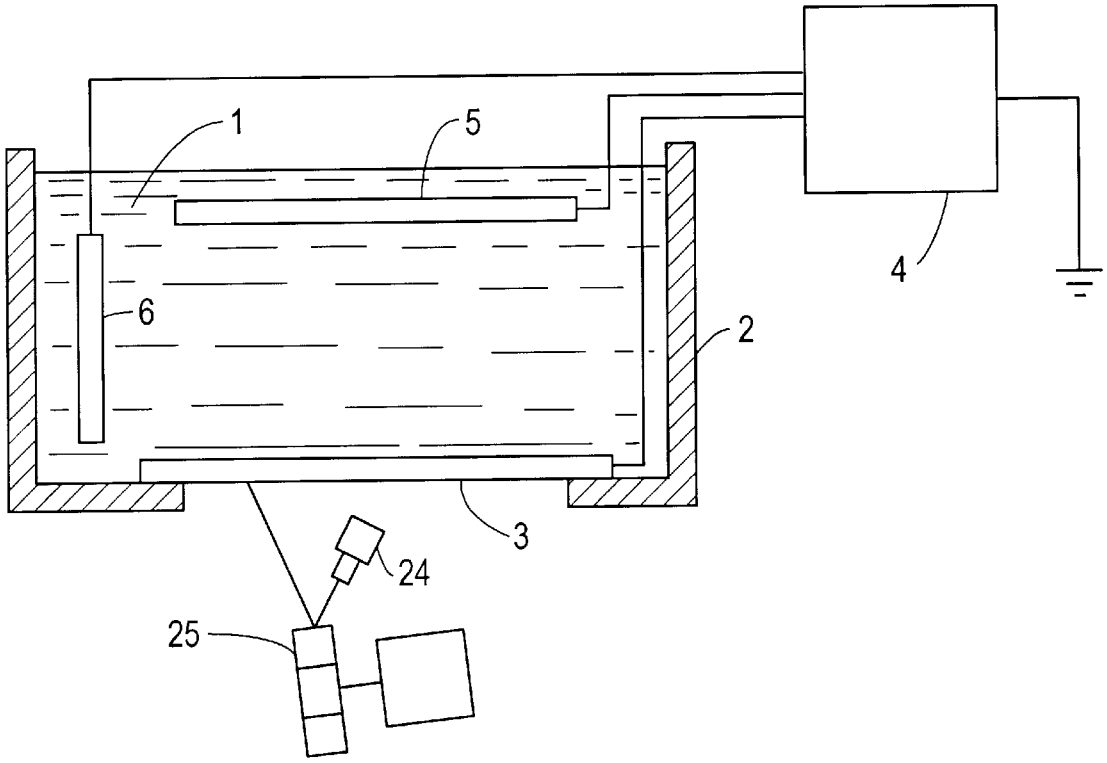
FIG. 7 is a schematic diagram illustrating an image recording apparatus which is equipped with a laser generator and which is used in image recording in Example 2.

Using an image recording apparatus as illustrated in FIG. 7, in a bath 2 filled with the electrodeposition liquid was disposed an image supporting member 3, whose rear surface was fitted with a working electrode so that an image signal could be inputted, in such a manner that the rear surface was exposed to the outside of the bath. Further, in the bath 2 were disposed a counter electrode 5 and a controlling electrode 6 utilizing a salt bridge. The image supporting member 3 had a multilayered structure comprising a 2 mm thick glass substrate having a transparent electrically conductive layer of ITO formed thereon, and the transparent electrically conductive layer was covered with two organic photoconductive layers. The electrically conductive layer of ITO functioned as a working electrode and the surface of the organic photoconductive layer had a surface roughness (Ra) of 0.1 μm and a critical surface energy of 24 dyne/cm. The respective electrodes were connected to a potentiostat power source. An image signal was inputted into an optical image inputting section on the rear surface of the image supporting member by a He—Ne laser ray which was controlled by laser scanning system 25 and radiated from a laser source 24, while a DC pulse voltage of 3.0 V (having a pulse width of 2 ms/pulse cycle of 3 ms) was applied between the working electrode and the counter electrode by means of the potentiostat power source 4.

Next, the image supporting member was withdrawn from the liquid, and the unnecessary liquid on the image supporting member was removed with an air knife. Then, a sheet of plain paper was placed on the surface of the image supporting member having the image adhered thereto, and the image was transferred to the plain paper by bringing a rubber roller having a diameter of 50 mm into contact with the image supporting member by providing a line pressure of 170 g/cm, with the plain paper being sandwiched therebetween. At the time of the transfer, the image portion had a liquid content of 36% by weight.

After the completion of the image formation, it was confirmed that a high-quality image having an optical image density of 1.42 was formed on the plain paper.

Example 3

10 parts by weight of phthalocyanine powder (having an average particle diameter of 0.1 μm), 10 parts by weight of ethyl cellosolve, 7 parts by weight of lithium polyoxyethylene alkylphenylacetate, 4 parts by weight of lithium polymethyl acrylate dicarboxylate, 12 parts by weight of a water-soluble acrylic resin solution, and 40 parts by weight of distilled water were mixed, and moderately stirred for 0.5 hours by means of a propeller to sufficiently wet the pigment powder with the liquid and thus to prepare a dispersion liquid containing roughly dispersed pigment powder. This dispersion liquid was then subjected to a dispersing treatment using a homogenizer for 4 minutes to prepare a base dispersion liquid. Into this based dispersion liquid was dropwise added a dilute solution containing 200 parts by weight of distilled water and 0.5 parts by weight of an anti-mold agent ((Proxycel XL-2 manufactured by ICI Inc.) while the liquid was stirred with a propeller. In this way, a dispersion liquid containing fine particles of a coloring material for use in electro deposition was prepared. The pH of this liquid was set to 7.0 by adjusting the pH using an aqueous solution of phosphoric acid and an aqueous solution of lithium hydroxide. The pH at which the fine particles of the coloring material starting depositing from the liquid was 4.0. The volume resistivity of the liquid was $2.1\times10^2$ Ω·cm.

Figure 8:
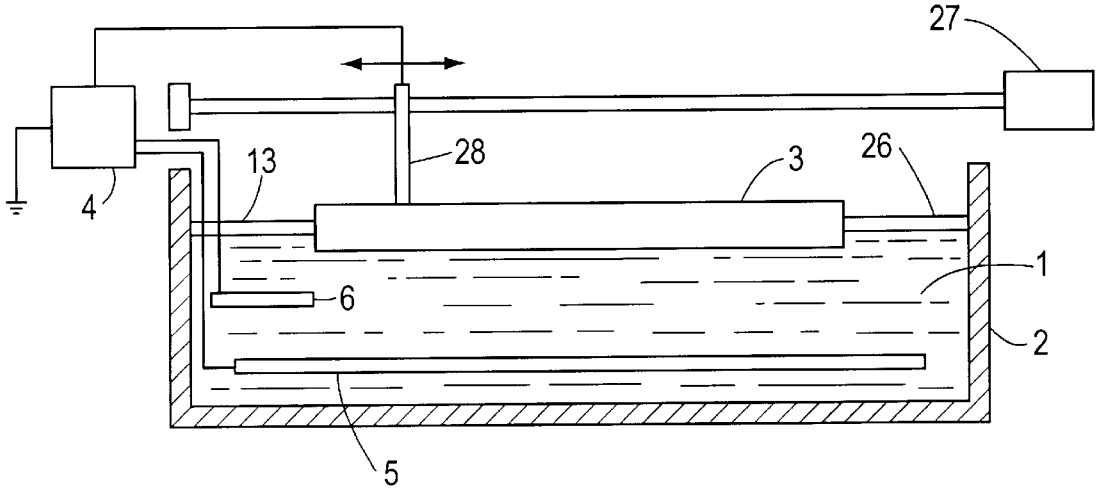
FIG. 8 is a schematic diagram illustrating an image recording apparatus which is equipped with an LED printing head and which is used in image recording in Example 3.

Using the image recording apparatus as illustrated in FIG. 8, in a bath 2 filled with the electrodeposition liquid was disposed an image supporting member 3, whose rear surface was fitted with a working electrode so that an image signal could be inputted, in such a manner that the rear surface was exposed to the outside of the bath by fixing the image supporting member with a jig 26 designed for fixing the image supporting member. Further, in the bath 2 were disposed a counter electrode 5 and a controlling electrode 6 utilizing a salt bridge. The image supporting member 3 had a multilayered structure comprising a 1 mm thick quartz substrate having a transparent electrically conductive layer of ITO formed thereon, and the transparent electrically conductive layer was covered with two organic photoconductive layers. The electrically conductive layer of ITO functioned as a working electrode and the surface of the organic photoconductive layer had a surface roughness (Ra) of 0.1 μm and a critical surface energy of 27 dyne/cm. The respective electrodes were connected to a potentiostat power source 4. An image signal was inputted into an optical image inputting section on the rear surface of the image supporting member 3 by an LED printing head 28 controlled by a printing head scanning system 27 while a DC pulse voltage of 2.2 V (having a pulse width of 2 ms/pulse cycle of 3 ms) was applied between the working electrode and the counter electrode by means of the potentiostat power source 4.

Next, the image supporting member was withdrawn from the liquid, and the formation of a cyan image on the surface of the image supporting member was confirmed. Then, the cyan image on the image supporting member was transferred to a sheet of plain paper by passing the paper through the gap between the planar working electrode of the image supporting member and an electrode having a built-in pressing roller while a DC pulse of 500 V and a pressure of 200 g/cm were applied between the gap. After the completion of the image transfer, it was confirmed that a high-quality image having an optical image density of 1.20 was formed on the plain paper. At the time of the transfer, the image portion had a liquid content of 41% by weight.

Comparative Example 1

In order to adhere an image to the image supporting member, the procedure of Example 1 was repeated, except that a DC voltage of 3.9 V was applied between the working electrode and the counter electrode for 3 seconds.

Next, the image supporting member was withdrawn from the liquid, and the image supporting member was dried in an oven kept at 60° C. for 8 minutes. Then, 10 seconds later, a sheet of plain paper was placed on the side having the image adhered of the image supporting member, and the image was transferred to the plain paper by sandwiching the plain paper between a rubber roller having a diameter of 50 mm and the image supporting member by applying a line pressure of 250 g/cm. At the time of the transfer, the image portion had a liquid content of 12% by weight. After the completion of the image transfer, it was found that the image had a nonuniform density and an optical image density as low as 0.21.

Comparative Example 2

In order to adhere an image to the image supporting member, the procedure of Example 1 was repeated, except that a DC voltage of 1.9 V was applied between the working electrode and the counter electrode for 5 seconds.

Next, the image supporting member was withdrawn from the liquid. Then, 10 seconds later, a sheet of plain paper was placed on the surface of the image supporting member having the image adhered thereto, and the image was transferred to the plain paper by sandwiching the plain paper between a rubber roller having a diameter of 50 mm and the image supporting member by applying a line pressure of 250 g/cm. At the time of the transfer, the image portion had a liquid content of 74% by weight. After the completion of the image transfer, it was found that the image had an optical image density as low as 0.63.

Based on the above results, it can be understood that a high-quality image can be obtained where the image forming material deposited on the surface of the image supporting member is transferred to a recording medium in a condition where the image forming material contains from20 to 60% by weight of the aqueous liquid.

Example 4

A dispersion liquid for use in electrodeposition was prepared as in Example 1, and printing was performed by electrodeposition. After the printing process, the image supporting member was withdrawn from the electrodeposition bath. The surface of the image supporting member was then dried under an air blast of 50° C. for 10 seconds. Next, a sheet of plain paper was placed on the surface of the image supporting member, where the image of dispersed fine particles of the coloring material was present. At this time of transfer, the image portion had a liquid content of 31% by weight. A corona discharge was performed at a voltage of +6 KV on the plain paper, and the plain paper and the image supporting member were sandwiched between a pair of rubber rollers and conveyed forward by the rotation of the rollers while a line pressure of 300 g/cm was applied. Immediately after the pressing, the plain paper was peeled from the image supporting member. It was found that the image thus transferred to the plain paper had an optical image density of 1.33.

Example 5

15 parts by weight carbon black powder (having an average particle diameter of 0.1 μm), 5 parts by weight of sodium polyoxyethylene alkylether carboxylate, 3 parts by weight of sodium polyethylene glycol dicarboxylate, 6 parts by weight of a water-soluble acrylic resin, and 55 parts by weight of distilled water were mixed, and moderately stirred for 1 hour by means of a propeller to sufficiently wet the carbon black powder with the liquid and thus to prepare a dispersion liquid containing roughly dispersed carbon black powder. This dispersion liquid was then subjected to an intensive, forced-dispersing treatment using a homogenizer for 3 minutes to prepare a base dispersion liquid. Into this base dispersion liquid was dropwise added a diluent containing 100 parts by weight of distilled water, 20 parts by weight of an aqueous emulsion of vinyl acetate, and 0.6 parts by weight of an anti-mold agent (Proxycel XL-2 manufactured by ICI Inc.) while the liquid was stirred with a propeller. In this way, a dispersion liquid containing fine particles of a coloring material for use in electrodeposition was prepared. The pH of this liquid was set to 7.1 by adjusting the pH using an aqueous solution of phosphoric acid and an aqueous solution of sodium hydroxide. The pH at which the fine particles of the coloring material started depositing from the liquid was 5.5. The volume resistivity of the liquid was $2\times10^2$ Ω·cm.

In the image recording apparatus as illustrated in FIG. 5, this aqueous coloring material liquid was used to record an image. As shown in FIG. 5, in a bath 2 filled with the electrodeposition liquid 1 was disposed an image supporting member 3, whose rear surface was fitted with a working electrode so that an image signal could be inputted, in such a manner that the rear surface was exposed to the outside of the bath. Further, in the bath 2 were disposed a counter electrode 5 and a controlling electrode 6 utilizing a salt bridge. The image supporting member 3 had a multilayered structure comprising a 4 mm thick blue plate glass substrate having a transparent electrically conductive layer of ITO formed thereon, and the transparent electrically conductive layer was covered with two organic photoconductive layers. The electrically conductive layer of ITO functioned as a working electrode and the surface of the organic photoconductive layer was smooth without unevenness. The surface roughness (Ra) of the surface was 0.3 μm, and the critical surface tension was 27 dyne/cm. The respective electrodes were connected to a potentiostat power source. An image signal was inputted into an optical image inputting section on the rear surface of the image supporting member by an image-projecting light 23 radiated from an image projecting device 22 while a DC voltage of 2.0 V was applied between the working electrode and the counter electrode by means of the potentiostat power source for 5 seconds.

Next, the image supporting member was withdrawn from the liquid. Then, 20 seconds later, a sheet of plain paper was placed on the surface of the image supporting member having the image adhered thereto, and the image was transferred to the plain paper by bringing a rubber roller having a diameter of 50 mm into contact with the image supporting member by providing a line pressure of 250 g/cm , with the plain paper being sandwiched therebetween. At the time of the transfer, the image portion had a liquid content of 38% by weight. After the completion of the image formation, it was confirmed that a high-quality image having an optical image density of 1.35 was formed on the plain paper.

Then, the fixing performance of the image was tested by rubbing the image with a rubber eraser. According to this test, the change in optical density of the printed sample of this example was found to be 0.3, while the change in optical density of the printed sample of Example 1 was found to be 0.5. This result confirms that the addition of the aqueous emulsion improved the fixing performance.

Example 6

As in Example 1, aqueous liquids each containing a coloring material for use in electrodeposition were prepared by using a different pigment powder in each liquid, i.e., carbon black powder (having an average particle diameter of 0.08 $\mu$m), carbon black powder (having an average particle diameter of 0.03 $\mu$m), carbon black powder (having an average particle diameter of 0.8 $\mu$m), and carbon black powder (having an average particle diameter of 2.0 $\mu$m). The images recorded on plain paper by printing were evaluated. At the time of the transfer, the image portion had a liquid content of 42% by weight.

According to the evaluation results, on the plain paper, the optical densities resulting from the four aqueous liquids each containing a coloring material for use in electrodeposition were 1.34, 1.41, 1.16, and 0.43, respectively. The dispersion stability of the aqueous liquid containing a carbon black having an average particle diameter of 2.0 $\mu$m for use in electrodeposition was so poor that a precipitate was formed on the bottom of the test tube for the evaluation of precipitation after the sample had been left to stand for 2 days. None of the aqueous liquids containing other carbon black powders produced any precipitate on the bottom of the test tube for the evaluation of precipitation after the samples had been left to stand for 2 days.

Example 7

The same aqueous liquid containing a coloring material for use in electrodeposition as in Example 2 was prepared by repeating the procedure of Example 2.

Using an image recording apparatus as illustrated in FIG. 7, in a bath 2 filled with the electrodeposition liquid was disposed an image supporting member3, whose rear surface was fitted with a working electrode so that an image signal could be inputted, in such a manner that the rear surface was exposed to the outside of the bath. Further, in the bath 2 were disposed a counter electrode 5 and a controlling electrode 6 utilizing a salt bridge. The image supporting member 3 had a multilayered structure comprising a 2 mm thick glass substrate having a transparent electrically conductive layer of ITO formed thereon, and the transparent electrically conductive layer was covered with two organic photoconductive layers. The electrically conductive layer of ITO functioned as a working electrode and the surface of the organic photoconductive layer had a surface roughness (Ra) of 0.1 $\mu$m and a critical surface energy of 24 dyne/cm. The respective electrodes were connected to a potentiostat power source. An image signal was inputted into an optical image inputting section on the rear surface of the image supporting member by a He—Ne laser ray which was controlled by laser scanning system 25 and radiated from a laser source 24, while a DC pulse voltage of 3.0 V (having a pulse width of 2 ms/pulse cycle of 3 ms) was applied between the working electrode and the counter electrode by means of the potentiostat power source 4. In this case, the recording by electrodeposition was performed by lightly stirring the electrodeposition liquid in the bath by means of a stirring propeller placed in the bath.

Next, the image supporting member was withdrawn from the liquid, and the unnecessary liquid on the image supporting member was removed with an air knife. Then, a sheet of plain paper was placed on the side of the image supporting member having the image adhered thereto, and the image was transferred to the plain paper by bringing a rubber roller having a diameter of 50 mm into contact with the image supporting member by providing a line pressure of 190 g/cm , with the plain paper being sandwiched therebetween. At the time of the transfer, the image portion had a liquid content of 34% by weight.

After the completion of the image formation, it was confirmed that an image having an optical image density of 1.46 was formed on the plain paper. It was also confirmed that the optical density dispersion a was 0.04 in the solid region. Meanwhile, the image formed in Example 2 had an optical image density of 1.42 and an optical density dispersion $\sigma$ of 0.09 in the solid region. Accordingly, it becomes clear that the light stirring of the electrodeposition liquid in the bath provides a high-quality image having a uniform optical density.

Example 8

An aqueous dispersion liquid for use in electrodeposition was prepared as in Example 2, and printing was performed by electrodeposition. After the printing process, the image supporting member was withdrawn from the electrodeposition bath, and left to stand for 1 minute at room temperature. Then, a sheet of plain paper was placed on the surface of the image supporting member where the image of dispersed fine particles of the coloring material was present. The plain paper and the image supporting member were sandwiched by an electrically conductive roller and an electrically insulating roller and conveyed forward by the rotation of the rollers while a line pressure of 400 g/cm and a bias voltage of +300 V were applied to the electrically conductive rubber roller. Immediately after being conveyed forward by rotation of the rollers, the plain paper was peeled from the image supporting member. The image thus transferred to the plain paper had an optical image density of 1.43. At this time of transfer, the image portion had a liquid content of 36% by weight. Then, the image forming material remaining on the image supporting member after transfer was removed by using a rubber blade. In this way, the surface of the image supporting member was returned to its initial state and was ready for the next image formation.

Example 9

17 parts by weight carbon black powder (having an average particle diameter of 0.1 $\mu$m), 3 parts by weight of sodium polyoxyethylene alkylether carboxylate, 3 parts by weight of sodium polyethylene glycol dicarboxylate, 10 parts by weight of a water-soluble acrylic resin, and 55 parts by weight of distilled water were mixed, and moderately stirred for 1 hour by means of a propeller to sufficiently wet the carbon black powder with the liquid and thus to prepare a dispersion liquid containing roughly dispersed carbon black powder. This dispersion liquid was then subjected to an intensive, forced-dispersing treatment using a homogenizer for 3 minutes to prepare a base dispersion liquid. Into this base dispersion liquid was dropwise added a diluent containing 120 parts by weight of distilled water, 10 parts by weight of glycerin, and 0.3 parts by weight of an anti-mold agent (Proxycel XL-2 manufactured by ICI Inc.) while the liquid was stirred with a propeller. In this way, a dispersion liquid containing fine particles of a coloring material for use in electrodeposition was prepared. The pH values of this liquid were set to 4.5, 6.0, 7.5 and 9.5 respectively by adjusting pH by an aqueous solution of hydrochloric acid and an aqueous solution of sodium hydroxide. The pH at which the fine particles of the coloring material started depositing from the liquid was 5.0.

Figure 2A:
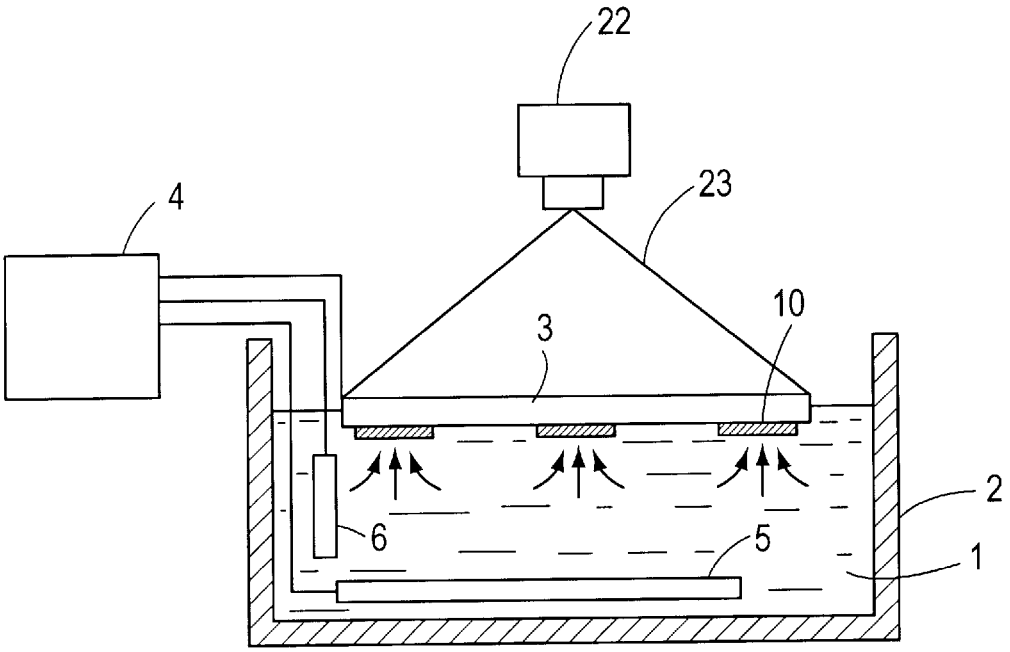
FIG. 2A is a schematic diagram illustrating the above-described image recording process.
Figure 2B:
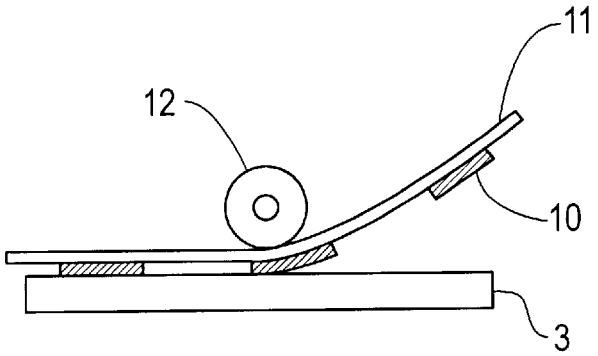
FIG. 2B is a schematic diagram illustrating the image transferring process.
Figure 2C:
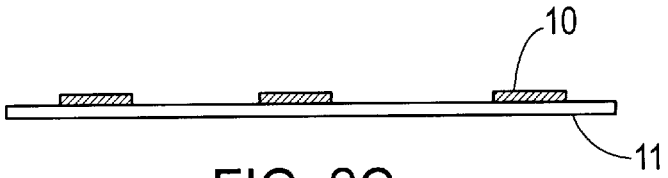
FIG. 2C is a schematic diagram illustrating an image which has been transferred and fixed to a sheet of plain paper.

In the image recording apparatus as illustrated in FIG. 2, this aqueous coloring material liquid was used to record an image. As shown in FIG. 2, in a bath 2 filled with the electrodeposition liquid 1 was disposed an image supporting member 3, whose rear surface was fitted with a working electrode so that an image signal could be inputted, in such a manner that the rear surface was exposed to the outside of the bath. Further, in the bath 2 were disposed a counter electrode 5 and a controlling electrode 6 utilizing a salt bridge. The image supporting member 3 had a multilayered structure comprising a 4 mm thick blue plate glass substrate having a transparent electrically conductive layer of ITO formed thereon, and the transparent electrically conductive layer was covered with two organic photoconductive layers. The electrically conductive layer of ITO functioned as a working electrode and the surface of the organic photoconductive layer was smooth without unevenness. The surface roughness (Ra) of the surface was 0.3 $\mu$m, and the critical surface tension was 27 dyne/cm. The respective electrodes were connected to a potentiostat power source. An image signal was inputted into an optical image inputting section on the rear surface of the image supporting member by an image-projecting light 23 radiated from an image projecting device 22 while a DC voltage of 2.5 V was applied between the working electrode and the counter electrode by means of the potentiostat power source for 12 seconds.

Next, the image supporting member was withdrawn from the liquid. Then, 14 seconds later, a sheet of plain paper was placed on the surface of the image supporting member having the image adhered thereto, and the image was transferred to the plain paper by bringing a rubber roller having a diameter of 50 mm into contact with the image supporting member by providing a line pressure of 350 g/cm, with the plain paper being sandwiched therebetween. At the time of the transfer, the image portion had a liquid content of 39% by weight. After the completion of the image formation, the optical densities on the plain paper were measured. The respective optical image densities were 1.43 (for electrodeposition liquid having pH of 4.5), 1.38 (for electrodeposition liquid having pH of 6.0), 1.32 (for electrodeposition liquid having pH of 7.5), and 1.01 (for electrodeposition liquid having pH of 9.5). Besides, the electrodeposition liquid having pH of 4.5 caused the dispersed particles to precipitate on the bottom of the bath, thereby indicating an unstable state of dispersion.

What is claimed is:

1. An image forming method comprising the steps of preparing an aqueous coloring material liquid by dissolving or dispersing fine particles of a coloring material in an aqueous liquid, disposing an image supporting member and a counter electrode opposite thereto in the aqueous coloring material liquid, supplying an electric current or an electric field corresponding to an image pattern between the image supporting member and the counter electrode, electrochemically depositing an image forming material containing the fine particles of the coloring material on the surface of the image supporting member thereby forming an image, and transferring the image forming material, in a condition where the image forming material contains 20 to 60% by weight of the aqueous liquid, onto a recording medium so as to record the image on the recording medium.

2. An image recording method according to claim 1, wherein the fine particles of a coloring material are at least fine particles of a coloring material having an average particle diameter of 0.9 $\mu$m or less.

3. An image recording method according to claim 1, wherein the image supporting member has a photoconductive layer containing a photoconductive material and an image corresponding to an image pattern is formed on the surface of the image supporting member by providing an optical signal corresponding to the image pattern on the photoconductive layer of the image supporting member.

4. An image recording method according to claim 1, wherein the fine particles of a coloring material can be converted into ions having a polarity opposite to the polarity of the image supporting member.

5. An image recording method according to claim 1, wherein the difference in potential between the image supporting member and the counter electrode is 9 V or less.

6. An image recording method according to claim 1, wherein a dispersant for use in electrodeposition causes the fine particles of the coloring material to be dispersed in the aqueous coloring material liquid.

7. An image recording method according to claim 6, wherein an image pattern part is electrically positive relative to a base electrode, and the aqueous coloring material liquid contains, as the dispersant for use in electrodeposition, at lease one compound capable of causing an ionic dissociation in the aqueous liquid so as to have one or more anionic groups.

8. An image recording method according to claim 6, wherein an image pattern part is electrically negative relative to a base electrode, and the aqueous coloring material liquid contains, as the dispersant for use in electrodeposition, at lease one compound capable of causing an ionic dissociation in the aqueous liquid so as to have one or more cationic groups.

9. An image recording method according to claim 1, wherein the critical surface tension of the surface of the image supporting member is 39 dyne/cm or less.

10. An image recording method according to claim 1, wherein the surface roughness (Ra) of the image supporting member is 0.01 $\mu$m or more and 1.2 $\mu$m or less.

11. An image recording method according to claim 1, wherein the image forming material contains a thermoplastic resin component.

12. An image recording method according to claim 1, wherein the image supporting member is structured in the shape of a belt.

13. An image recording method according to claim 1, wherein the aqueous coloring material liquid further contains a water-soluble polymeric material so that the water-soluble polymeric material also adheres as part of the image forming material to the image pattern part on the surface of the image supporting member at the time of image formation.

14. An image recording method according to claim 1, wherein the aqueous coloring material liquid further contains particles of an emulsion so that the particles of the emulsion are also deposited as part of the image forming material to the image pattern part on the surface of the image supporting member at the time of image formation.

15. An image recording method according to claim 1, wherein the average particle diameter of the particles of the coloring material is in the range of from 0.01 $\mu$m to 0.3 $\mu$m.

16. An image recording method according to claim 1, wherein the aqueous coloring material liquid further contains a water-soluble solvent having a boiling point of 120° C. or higher and a vapor pressure of $1.33\times10^4$ Pa or less in the atmosphere.

17. An image recording method according to claim 1, wherein the aqueous coloring material liquid has a volume resistivity of $10^5$ Ω·cm or less.

18. An image recording method according to claim 1, wherein the aqueous coloring material liquid is fluidized or stirred when an image is formed by supplying an electric current or an electric field corresponding to an image pattern between the image supporting member and the counter electrode so as to electrochemically deposit the image forming material containing the fine particles of the coloring material on the surface of the image supporting member thereby forming an image.

19. An image recording method according to claim 1, wherein the aqueous coloring material liquid further contains a chemical having a preservative and anti-mold effect.

20. An image recording method according to claim 1, wherein the temperature of the aqueous coloring material liquid is controlled when an image is formed by supplying an electric current or an electric field corresponding to an image pattern between the image supporting member and the counter electrode so as to electrochemically deposit the image forming material containing the f fine particles of the coloring material on the surface of the image supporting member thereby forming an image.

21. An image recording method according to claim 1, wherein the method further contains a step of removing unnecessary image forming material adhering to the surface of the image supporting member after the step of transferring the image forming material onto the recording medium.

22. An image recording method according to claim 1, wherein the pH of the aqueous coloring material liquid is set to a value falling within the range of (x−1)~(x+3), wherein x indicates a value at which the deposition starts in the case of an anodic deposition.

23. An image recording method according to claim 1, wherein the pH of the aqueous coloring material liquid is set to a value falling within the range of (x−3)~(x+1), wherein x indicates a value at which the deposition starts in the case of a cathodic deposition.

24. An image recording method according to claim 1, wherein the concentration of solid components of the aqueous coloring material liquid is more than 1% by weight and less than 30% by weight.

25. An image recording method according to claim 24, wherein the content of the fine particles of the coloring material in the solid components is more than 30% by weight and less than 80% by weight.

* * * * *